US007651328B2

(12) United States Patent
Gebhart et al.

(10) Patent No.: US 7,651,328 B2
(45) Date of Patent: Jan. 26, 2010

(54) PROCESS AND APPARATUS FOR ARTIFICIALLY AGEING BLOCKS

(75) Inventors: Hans Gebhart, Memmingen (DE); Manfred Staehle, Leutkirch (DE); Roland Werner, Memmingen (DE)

(73) Assignee: Baustoffwerke Gebhart & Sohne GmbH & Co. KG, Aichstetten (DE)

( * ) Notice: Subject to any disclaimer, the term of this patent is extended or adjusted under 35 U.S.C. 154(b) by 533 days.

(21) Appl. No.: 11/233,355

(22) Filed: Nov. 4, 2005

(65) Prior Publication Data

US 2006/0288658 A1 Dec. 28, 2006

(30) Foreign Application Priority Data

Jun. 22, 2005 (DE) ..... 10 2005 029 212

(51) Int. Cl.
*B28B 11/08* (2006.01)

(52) U.S. Cl. ..... 425/343; 264/293

(58) Field of Classification Search ..... 425/343, 425/385

See application file for complete search history.

(56) References Cited

U.S. PATENT DOCUMENTS 4,147,491 A * 4/1979 Postell, Jr. ..... 425/385
6,109,906 A * 8/2000 Castonguay et al. ..... 425/343
6,540,501 B1 * 4/2003 Bott ..... 425/385
6,561,786 B2 * 5/2003 Ciccarello ..... 425/343
2002/0145224 A1 10/2002 Ciccarello
2003/0173697 A1 * 9/2003 Ciccarello et al. ..... 264/138
2004/0187856 A1 * 9/2004 Schlough et al. ..... 125/13.01

FOREIGN PATENT DOCUMENTS

DE 29 22 393 12/1979
DE 36 21 276 A1 1/1988
DE 2004 015348 U 2/2004
DE 2004 015348 U 12/2004
DE 2004 020206 U 12/2004
DE 2004 020206 U 3/2005
EP 0 860 258 B1 5/2003

* cited by examiner

*Primary Examiner*—Joseph S. Del Sole
*Assistant Examiner*—John P Robitaille
(74) *Attorney, Agent, or Firm*—Davis & Bujold, P.L.L.C.

(57) ABSTRACT

An apparatus for the artificial ageing of blocks, in particular concrete blocks, clinker bricks and natural stone blocks, has a base on which the blocks can be placed in such a way that their surfaces to be treated and the adjoining edges are exposed. Essentially freely movable striking bodies are used for treating the surfaces and the adjoining edges of the blocks. A vibrating device sets the blocks and the striking bodies in motion relative to one another in such a way that the striking bodies act on the surfaces and the exposed edges of the blocks. In this case, the striking bodies are movably fastened to a retaining device in such a way that the striking bodies are freely movable within a defined region of the surface of the blocks.

33 Claims, 4 Drawing Sheets

PROCESS AND APPARATUS FOR ARTIFICIALLY AGEING BLOCKS

This application claims priority from German Application Serial No. 10 2005 029 212.7 filed Jun. 22, 2005.

FIELD OF THE INVENTION

The invention relates to an apparatus for the artificial ageing of blocks, in particular concrete blocks, clinker bricks and natural stone blocks. The present invention also relates to a method for the artificial ageing of blocks.

BACKGROUND OF THE INVENTION

An apparatus of the generic type for ageing has been disclosed by DE 20 2004 020 206.9.

Blocks, for example, surfacing elements, facade elements, sand-lime blocks, concrete blocks, bricks or clinker bricks, natural stone blocks and the like, irrespective of their material condition, are often subjected to a subsequent treatment in order to lose their artificial appearance.

Freshly produced, set concrete blocks, in particular concrete paving blocks, are subjected to such a subsequent treatment especially frequently, in the course of which the surfaces and/or the edges are struck or broken in order to adapt the appearance to natural stone in this way. To this end, a relatively large number of concrete blocks are put into a rotary drum and "rumbled" there; the surfaces and edges of the blocks striking one another and the blocks thus treated leaving the drum in an "aged" state. Such an apparatus has been disclosed by DE-A 29 22 393.

During the treatment of the concrete blocks in a rotary drum, surfaces and edges which, for example when using the aged blocks, are not visible at all in a paving are also treated. To this extent, energy and time are needlessly wasted. Furthermore, it is necessary to put the treated concrete blocks leaving the rotary drum onto a pallet for dispatching in a regular arrangement, the amount of work and time which this involves being disproportionately high.

Sorting installations for sorting the blocks are known from the prior art, these sorting installations accordingly orienting the blocks and arranging them in a pallet form. Such sorting installations involve high procurement and operating costs and also take up a corresponding amount of space.

DE 36 21 276 C2 discloses a method in which concrete blocks are put onto a plate-like base in a single layer in a regular arrangement. The exposed surfaces and the adjoining exposed edges or essentially only the edges of the concrete blocks are then struck irregularly by way of a vibrating knocking or striking device.

Due to this method, a subsequent sorting device can be dispensed with, since the production layer is not changed. Before the treatment by the knocking or striking devices, the blocks are pushed together and oriented on the plate-like base, so that the blocks fit closely against one another and there is no longer any intermediate spaces between them. The striking tools of the striking device are arranged on a movable carriage which guides said striking tools across the surfaces of the blocks, so that the free surfaces of the blocks and those edges of the blocks lying at the top are struck by the striking tools.

A disadvantage with this method, however, is that the blocks aged in this way look artificially treated and not naturally aged. The use of the method of the generic publication does not result in ideal breaking of the edges of the blocks as is obtained by the rumbling of the blocks in a rotary drum.

Disclosed by EP 0 860 258 B2 is an apparatus and a method in which the blocks are arranged in one or two layers, preferably in their production layer, between two elements, preferably plates. In this case, the bottom plate, on which the concrete blocks rest, is in interaction with a vibrating device. The blocks are set in motion by the vibrating device so that they move back and forth between the plates. In the process, the blocks strike one another and also strike the top and the bottom plate as a result of which the edges on the top side and the underside are broken. In addition, the top sides and the undersides of the blocks are struck by the respectively assigned plates. The vertical side edges of the concrete blocks and the side faces are broken or struck by the respectively adjoining concrete blocks.

It has been found in tests that the breaking of the edges is all the poorer, the larger the block to be aged is. This results from the fact that the striking angle becomes all the smaller, the larger the block put between the plates is. The small striking angle results in unfavorable breaking of the edges.

As with the ageing method by way of the rotary drum, there is the disadvantage in this case that surfaces and edges of the blocks are treated which are possibly not visible at all, as a result of which energy and time are needlessly wasted. In addition, the requisite treatment time, in particular in the case of set concrete blocks, is long and the breaking of the edges is not ideal.

The generic publication DE 20 2004 020 206.9 discloses an apparatus for the artificial ageing of blocks in which the blocks (preferably in their production layer) are placed on a base, so that the surfaces to be treated and the adjoining edges of the blocks are exposed. By way of a magnet, freely movable striking bodies (of metal) are then applied to the surface to be treated. The base on which the blocks rest is set in vibration by way of a vibrating device. The blocks and the striking bodies are, therefore, set in motion relative to one another in such a way that the striking bodies act on the surfaces and the exposed edges of the blocks.

The apparatus disclosed by DE 20 2004 020 206.9 enables rapid and effective ageing of the top side of the blocks and the adjoining, exposed edges. The striking bodies randomly hit the surface of the blocks and, therefore, strike the latter irregularly, so that an optical effect is produced which corresponds to that of a naturally aged block.

According to the ageing process, the metallic striking bodies are lifted from the surface of the blocks again by the magnet by the latter being brought close to the blocks. The block layer can be removed and a new block layer can be fed. It is a disadvantage that the magnet to be used involves high costs. A further disadvantage is that downtimes occur due to the striking bodies being put down and picked up again by the magnet and these downtimes lead to longer cycle times.

The object of the present invention is, therefore, to improve the apparatus disclosed by the generic publication for the artificial ageing of blocks, in particular to develop an apparatus and a method which permits especially cost-effective and rapid ageing of blocks.

SUMMARY OF THE INVENTION

Owing to the fact that the striking bodies are movably fastened, but this fastening allows a movement of the striking bodies within a defined region of the surface of the blocks. This achieves the effect that, first, surfaces or the adjoining edges of the blocks continue to be struck irregularly and thus an optical effect is produced which corresponds to that of a naturally aged block and, second, a magnet for putting down the striking bodies and picking them up again from the surface can be dispensed with. By the initiation of vibrations, for example caused by a vibrating table which is arranged under the blocks, the blocks and the striking bodies are set in motion relative to one another in the manner as described in the generic publication so that the striking bodies act on the surfaces and the adjoining edges of the blocks.

According to the invention, the solution permits a plurality of variants for setting down the striking bodies and for removing them from the surfaces of the blocks and thus makes it possible to dispense with a hitherto required magnet in several ways. For example, in one embodiment, provision may be made for the retaining device on which the striking bodies are movably fastened to perform a lifting movement in order to be able to lift the striking bodies from the surface of the blocks or to feed them to said surface. The lifting of the striking bodies from an aged layer of blocks and the placing of the striking bodies again on a new layer of blocks to be aged can be carried out very quickly in this manner so that short cycle times can be maintained. The downtimes are markedly reduced compared with the prior art.

As the inventor has recognized, a special advantage of the solution according to the invention consists in the fact that lifting the striking bodies and setting them down again can be completely dispensed with. This is because the movable fastening or suspension of the striking bodies enables the apparatus according to the invention to be designed with a conveying device, for example in the form of a push rod or a conveying band, which pushes the blocks to be aged continuously or discontinuously through below the movably fastened striking bodies. The expression "continuous ageing" also refers to an interval during which the blocks are pushed through below the striking bodies with brief interruptions of 5 seconds, for example. In the process, the striking bodies, excited in a conventional manner by the initiated vibrations, act on so as to age the blocks. As already described, the movable and flexible fastening ensures that, first, the blocks are struck unevenly and that, second, the striking bodies can be prevented from traveling along with the blocks. The striking bodies in each case age the blocks which are located within the defined region available to them.

The defined region may be selected, for example, as a function of the number of striking bodies, the number of blocks and the speed of passage.

It has been found in this case that just a relatively small region within which the striking bodies are movable on the surface of the blocks is sufficient. This avoids a situation in which the striking bodies (on account of excessive mobility) can penetrate into the intermediate space between two blocks and possibly jam there.

According to the invention, provision may be made for the striking bodies to be arranged unevenly or irregularly on a retaining device, arranged transversely to the feed direction, both in the feed direction and transversely thereto so that the blocks are not aged evenly.

Furthermore, according to the invention, provision may be made for the striking bodies to be arranged in a plurality of rows transversely to the feed direction of the blocks in such way that the rows of striking bodies in each case span the blocks conveyed through. The ageing effect may in this case be varied by the number of rows of striking bodies below which the blocks have to pass through under a striking action of the striking bodies. Furthermore, the intensity of the ageing is determined by the speed of passage and by the initiated vibrations.

Due to the selection of a suitable number of rows with striking bodies, according to the invention, the apparatus can be integrated in the continuous process for producing blocks in a simple manner without this leading to a reduction in the cycle time. The blocks can pass through the apparatus of the generic type at the desired speed; the desired ageing effect being achieved by the number of rows of striking bodies. The striking bodies of a row may in each case preferably be arranged offset from an upstream or downstream row of striking bodies so that the surfaces of the blocks are uniformly treated. In principle, a non-uniformly aged appearance should certainly be produced, but this is obtained automatically by the movable fastening of the striking bodies. The offset arrangement reliably avoids a situation in which the blocks are increasingly struck (in a lasting manner) within a certain region due to the system. Provision may also be made in this respect for the distance between the rows to vary.

In a configuration of the solution, according to the invention, with a continuously working conveying device, it is sufficient if at least the striking bodies of a row are arranged in such a way that their defined regions cover the entire width of the blocks passing through under the striking bodies.

In principle, just one row of striking bodies or a few rows of striking bodies may be sufficient in order to age the blocks. However, as has been found in practice, this does not produce an optimum ageing appearance and also results in the speed of passage being relatively low.

According to the invention, in a configuration of the solution in which no continuously working conveying device is provided, provision may be made for the striking bodies to be fastened in such a way that the defined regions of the individual striking bodies together cover at least the entire surface of the blocks, preferably fed in layers.

During the discontinuous ageing, provision is made for the blocks to be fed in layers or as a unit to the region in which they are aged and for them to be aged in one operation, i.e., the blocks are not transported further until the ageing has been completed.

In a modification of the discontinuous ageing, a plurality of ageing stations to which the blocks are fed in succession may also be provided; the blocks being aged in the desired manner after they have passed through all the ageing stations.

In contrast to the discontinuous ageing, provision is made during the continuous ageing for the blocks to be transported constantly in the feed direction; that is to say, a layer or unit of blocks is not fed specifically to the ageing station or stations, but rather the process is a continuous process. This is also possible by feeding the blocks at intervals. To this end, the vibrating process need not be interrupted. In this case, the blocks are left in their position (no feed) for a relatively short period of time, e.g., 5 seconds, and are then transported further by a short distance. In tests, this has resulted in an advantageous ageing appearance without the blocks being struck increasingly due to the system.

According to the invention, provision may be made for the defined regions of the striking bodies to overlap.

The space which is predetermined by the movable fastening and in which the striking bodies can move is preferably to be selected in such a way that the striking bodies cannot penetrate into the intermediate space possibly forming between two blocks. According to the invention, provision is made in this case for the striking bodies to rest on the blocks in the rest state, that is to say, when no vibrations act on the blocks and the striking bodies.

However, it is also possible for the striking bodies to be arranged at a distance above the blocks. The blocks can, therefore, be transported through below the striking bodies without being scratched. A distance between the blocks and the striking bodies is possible without any problems, in particular in the case of thicker blocks, since the latter can be aged with a high amplitude and are thus pushed up accordingly. As has been found, a distance increases the ageing of the block edges and reduces the ageing of the block surface, a factor which may be advantageous depending on the application or the desired appearance.

With regard to especially effective ageing, however, it is appropriate if the striking bodies rest on the surface and, therefore, do not first have to overcome a distance (loss of striking energy). In particular during the ageing of thin blocks, which are aged only with a low amplitude on account of the risk of said blocks being rotated by the vibrations, contact between the striking bodies and the surface of the blocks is also appropriate in the rest state.

Provision may be made for the defined region within which the striking bodies can move on the surface of the blocks to correspond to a movement or deflection of the same of 5-40 mm, preferably 10 mm, in all directions. Under the assumption that the striking bodies are spherical and have a diameter of 40 mm, this would result in a circular defined region having a diameter of preferably 60 mm. The circumference or the horizontal cross-section of the striking bodies is, therefore, extended by 10 mm horizontally in all directions for reproducing the defined region.

It is advantageous if the striking bodies are fastened in such a way that they can perform a largely unrestricted lifting movement, resulting from the initiated vibrations.

In a constructive configuration of the invention, provision is made in this case for the retaining device on which the striking bodies are fastened to be arranged above the blocks. Here, the retaining device may constitute a plane or a pattern of retaining elements which extend in a plane-parallel manner to the surface of the blocks and are formed, for example, by a plurality of retaining rows running transversely to the direction of passage of the blocks. The striking bodies may be fastened to the retaining elements, via fastening members, which may be designed, for example as chains, ropes, rods or profile elements of varying form. The fastening members may be designed in various ways and should, at the same time, preferably ensure that the striking bodies can move as far as possible without restriction within the defined region and that, on the other hand, the striking bodies can carry out the lifting movement without considerable energy loss. The striking bodies are preferably each fastened individually to the retaining elements.

In a configuration of the apparatus, according to the invention, with a continuously working conveying device, provision may be made for means which lift at least a section of a block to be provided in the region through which the blocks pass under a striking action of the striking bodies so that the lifted section of the block projects in the direction of the striking bodies and is subjected to a more intense action of the striking bodies. The means may be designed, for example as prominences, over which the underside of the blocks are pushed on account of the feed movement (resulting from the conveying device). The prominences may preferably be of ramp-shaped design, so that the block travels up the ramp with at least one section and then drops down again or travels down said ramp again. Thus, as viewed in the feed direction, first the front region of the block is lifted and is thus subjected to a more intense action of the striking bodies, whereas subsequently the middle region and finally the rear region of the block projects in the direction of the striking bodies.

According to the invention, provision may be made for the prominences to be arranged in such a way that the blocks, with their underside, are pushed eccentrically over the prominences, as a result of which one side of the block (as viewed in the direction of passage) is in each case subjected to increased ageing. Provision is made in this case for each block to be lifted at least once on each side. In order to reduce the friction between the prominence and the underside of the block, provision may be made for the prominences to have rollers or to be designed as rollers. However, owing to the fact that the blocks are continuously lifted in this region anyway by the vibrating movement, the friction between the prominence and the block underside is not high in any case.

The means for lifting the blocks may also be designed in such a way as described in US-2002/0145224 A1.

BRIEF DESCRIPTION OF THE DRAWINGS

The invention will now be described, by way of example, with reference to the accompanying drawings in which.

DETAILED DESCRIPTION OF THE INVENTION

According to the invention, any desired blocks, for example surfacing elements, facade elements, sand-lime blocks, concrete blocks, bricks or clinker bricks or natural stone blocks, can be aged irrespective of their material condition. The ageing of blocks 1 which are designed as concrete blocks will be explained below with reference to the exemplary embodiments. However, the invention is, of course, not restricted thereto.

The production of concrete blocks 1, in particular of concrete paving blocks, is sufficiently well known for which reason this will not be dealt with in any more detail below. The concrete blocks 1 leave the production plant generally in a production layer, i.e., in an arrangement in which the multiplicity of concrete blocks 1 are arranged next to one another in a single layer. Such a production layer is shown by way of example in FIG. 1.

Figure 1:
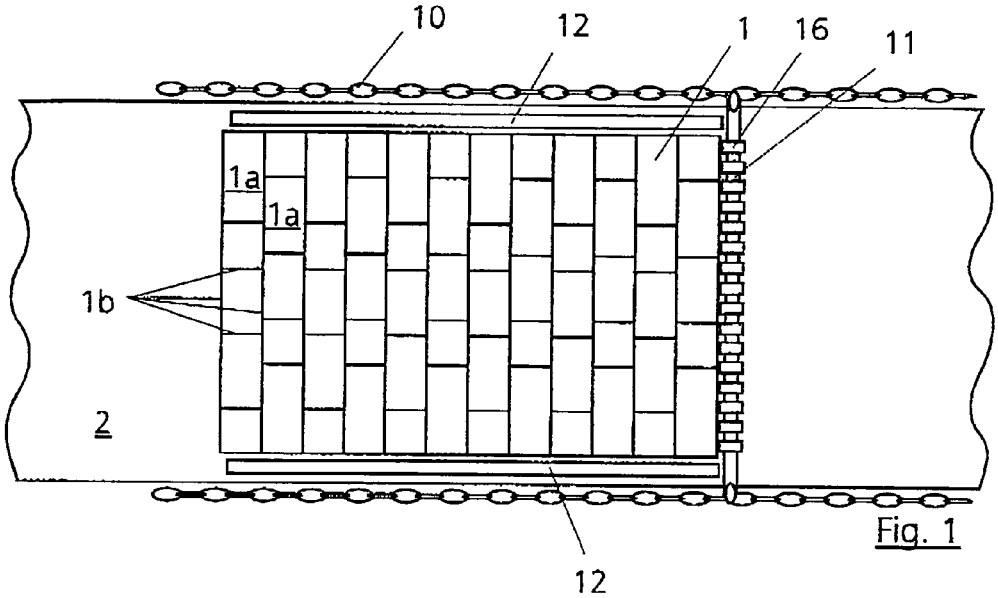
FIG. 1 shows a plan view of a production layer of blocks which are put onto a base and are brought into an ageing region by way of a conveying device, without the striking bodies being shown.

As can be seen from FIG. 1, the concrete blocks 1 are put onto a base 2 in a single layer in a regular arrangement. Here, the concrete blocks 1 are arranged in such a way that in each case that an edge 1*b* or a surface 1*a* (=the subsequent visible side as a rule) of the block 1 which is to be treated lies at the top.

With regard to the general principle of ageing with freely movable striking bodies 3, as can be seen from FIGS. 2 to 7, reference is made to DE 20 2004 020 206.9.

As can be seen from FIGS. 2 to 6, the surfaces 1*a* and the edges 1*b* adjoining the surfaces 1*a* of the blocks 1 are treated by striking bodies 3 which are essentially freely movable within a defined region 4 of the surface 1*a* of the blocks 1. To this end, the striking bodies 3 are movably fastened and arranged or suspended on a retaining device 5.

Figure 2:
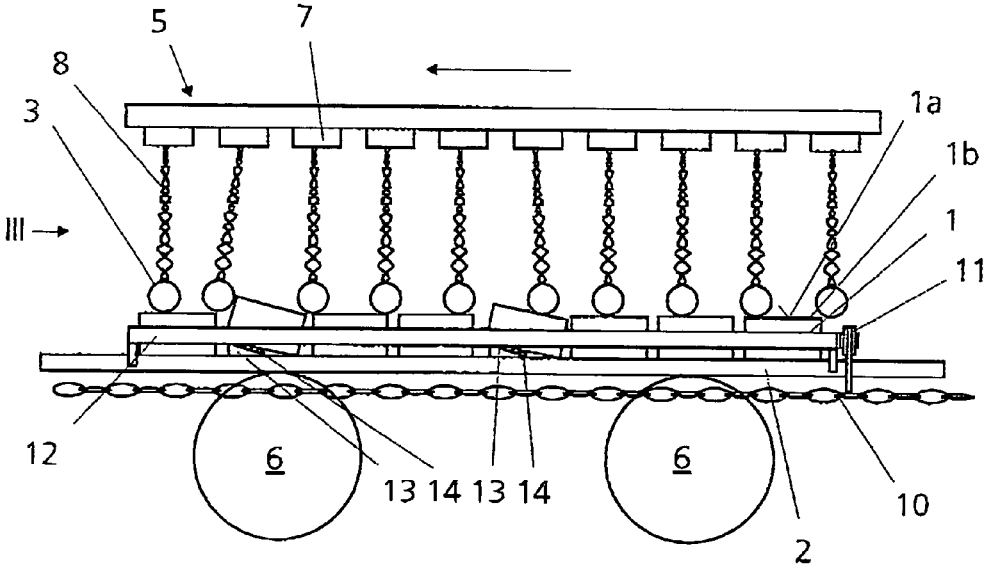
FIG. 2 shows a side view of the apparatus, according to the invention, the striking bodies being arranged in rows transversely to the push-through direction of the blocks via fastening elements.
Figure 3:
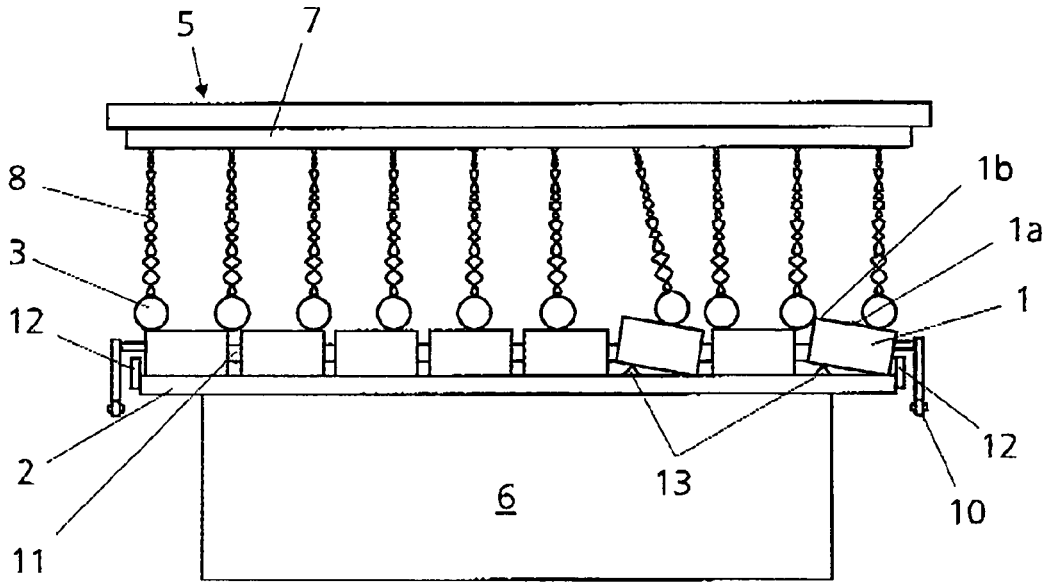
FIG. 3 shows a view according to arrow direction III in FIG. 2.

As can be seen in particular from FIGS. 2 and 3, a vibrating device 6 is provided in order to set the blocks 1 and the striking bodies 3 in motion relative to one another in such a way that the striking bodies 3 act on the surfaces 1*a* and the exposed edges 1*b* of the blocks 1. The vibrating device 6, which may consist, for example, of a plurality of unbalance generators, transmits the vibrating movement to the base 2 and acts from there on the blocks 1 and the striking bodies 3. In this case, the base 2 may also constitute the top side of the vibrating device 6, for example a vibrating table. However, the base 2 may also constitute a conveyor band, on which the blocks 1 are placed. With regard to advantageous configurations in this respect and to the initiation of the vibrating movement, reference is made to DE 20 2004 020 206.9.

As can be seen from the Figures, the striking bodies 3 are freely movable both within the defined region 4 relative to the surface 1*a* and relative to one another. The striking bodies 3 may be made of any desired material. In the exemplary embodiment, provision is made for the striking bodies 3 to be made of carbide, metal or steel. Any desired shape of the striking bodies 3 may, likewise, be selected; it having proved to be advantageous for the striking bodies 3 to be of spherical, annular, polygonal, cylindrical or disk-shaped design. In the exemplary embodiment shown, the striking bodies 3 are essentially spherical, but are flattened on two opposite sides. This can be seen in detail in particular from FIGS. 4, 6 and 7.

As can be seen when viewing FIG. 2 and FIG. 3 together, the retaining device 5 extends in a plane-parallel manner relative to the surfaces 1*a* of the blocks 1. In this case, the retaining device 5 has a plurality of retaining elements 7, which each extend over the entire width of the blocks 1 to be aged, i.e., transversely to the feed direction. The striking bodies 3 are arranged or fastened or suspended on retaining elements 7, via fastening members 8. According to the embodiment shown in FIGS. 2 to 4, the fastening members 8 are shown as chains. In this case, the chains are designed as metal chains. As can be seen, in particular from FIG. 4, the retaining elements 7 have rail-shaped receptacles 7*a*, in which the metal chains 8 can be hung. Each striking body 3 is connected individually to the retaining element 7 via an individual fastening member 8. If a striking body 3 has to be exchanged, this is therefore possible in a simple manner.

In the embodiment, provision is made for the striking bodies 3 of a row 7 to lie closely adjacent to one another, for example to be at a distance apart of 2 to 20 mm, preferably 5 to 10 mm.

Furthermore, provision is made in the exemplary embodiment for the retaining elements 7 or for the entire retaining device 5 to move during the striking action of the striking bodies 3 on the blocks 1. This assists irregular striking of the blocks 1 by the striking bodies 3. Provision is made in this case for an oscillating movement of the retaining elements 7, preferably in such a way that the retaining elements 7 are moved axially back and forth. This can be achieved from the design point of view with known means (e.g., an eccentric mounting or a randomly controlled pneumatic cylinder).

Figure 4:
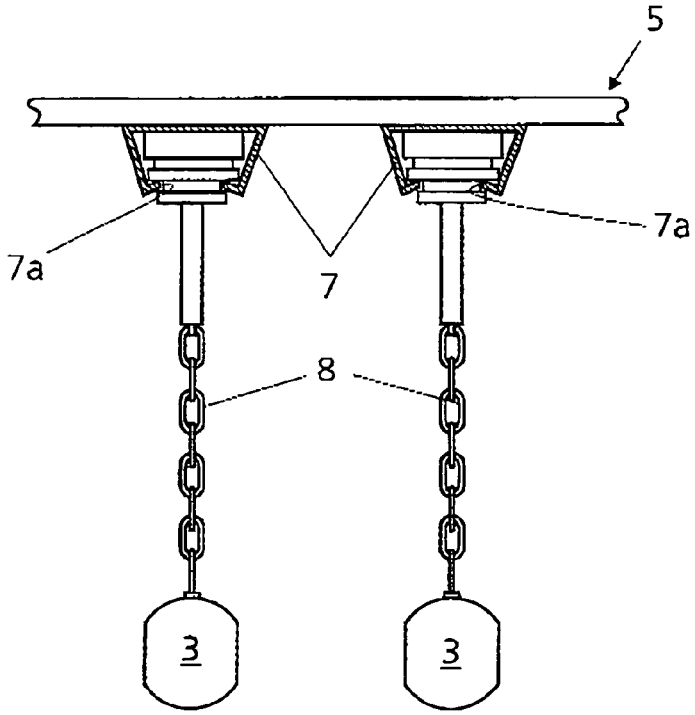
FIG. 4 shows a detailed view of the striking bodies, which are hung in rail-shaped receptacles via chain-shaped fastening elements.
Figure 5:
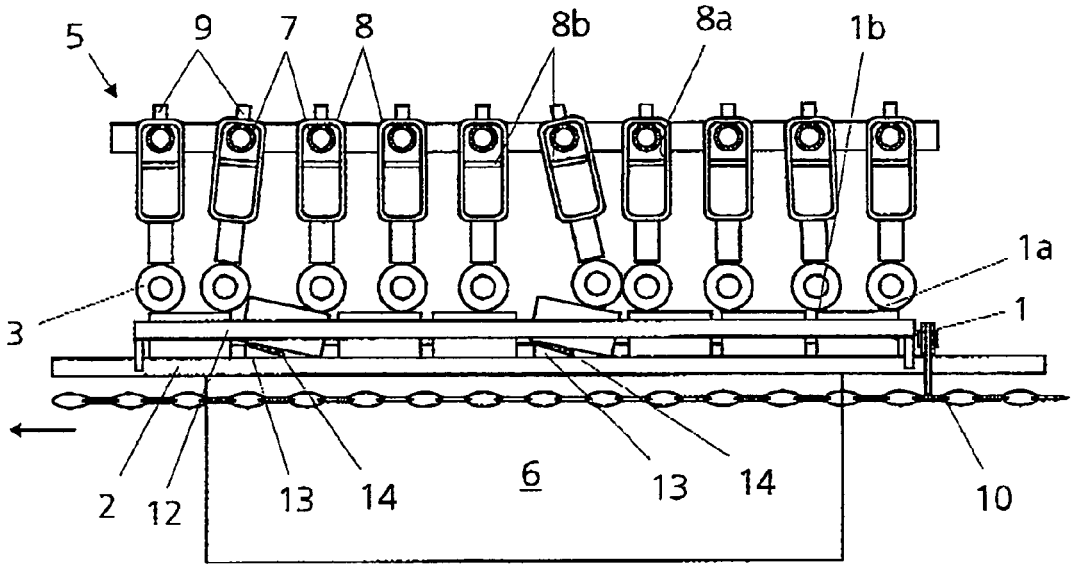
FIG. 5 shows an alternative configuration of the fastening elements with an interior space which encloses the retaining element.
Figure 6:
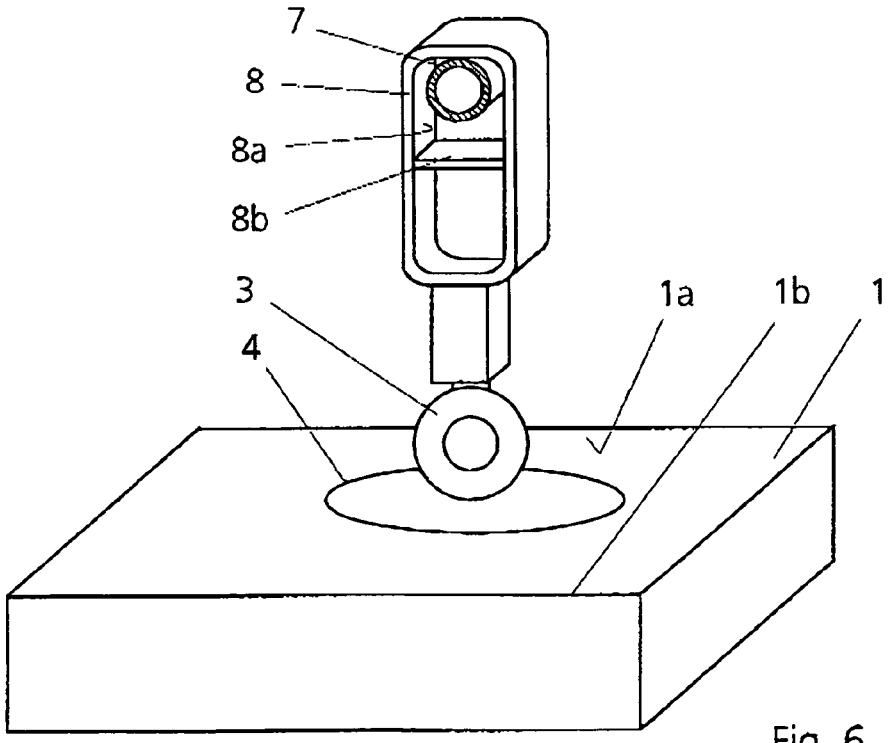
FIG. 6 shows a detailed illustration of a fastening element according to FIG. 5 with a striking body.
Figure 7:
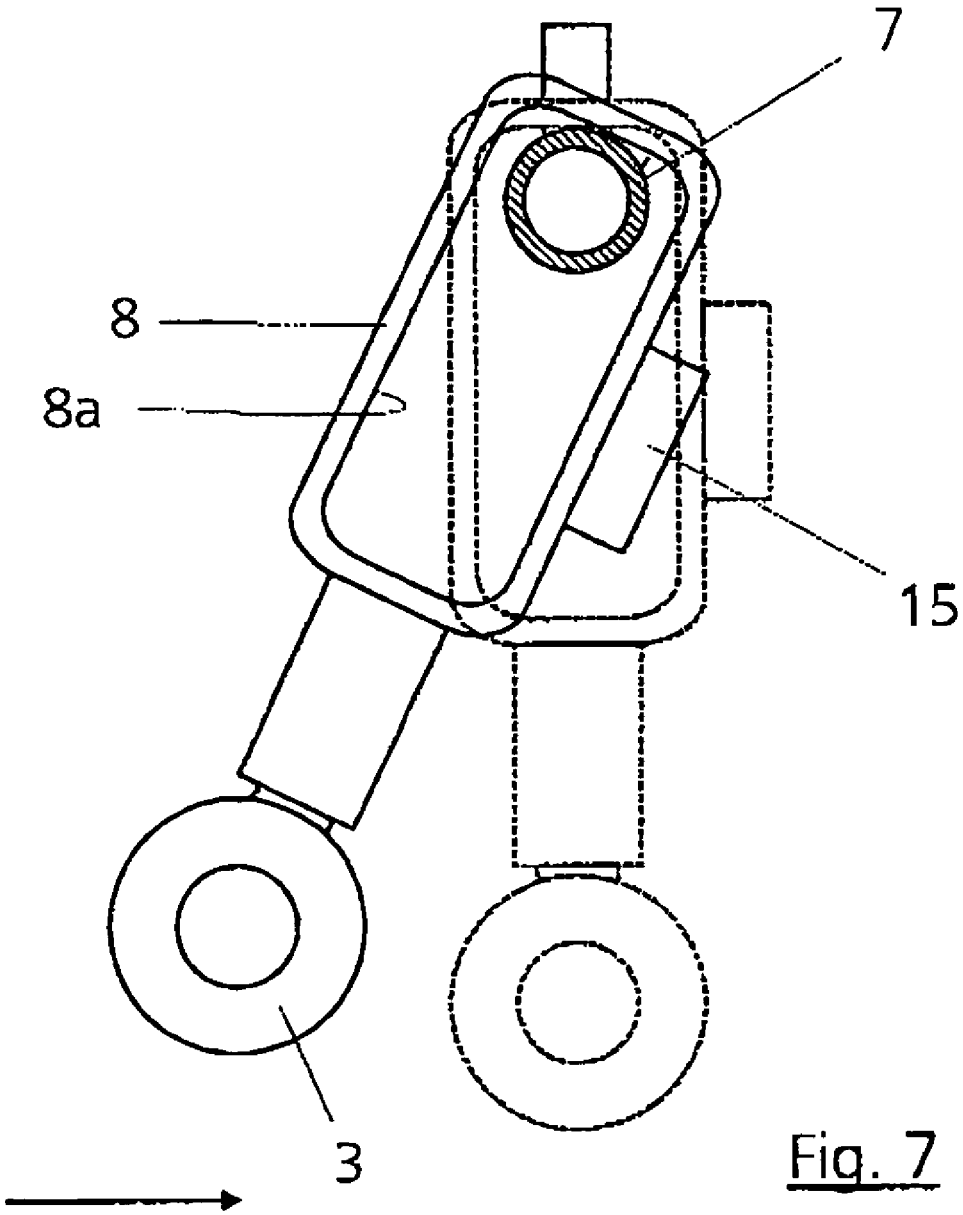
FIG. 7 shows a detailed illustration of a fastening element loaded eccentrically with a weight.

An alternative configuration of the fastening members 8 to that in FIGS. 2 to 4 is shown in FIGS. 5, 6 and 7. In this case, the fastening members 8 have a profile which forms an interior space 8*a*, which is suitable for enclosing the retaining element 7 (tubular or rod-shaped in the exemplary embodiment) in such a way that the fastening member 8 is movable relative to the retaining element 7 in such a way that the striking body 3 arranged on the fastening member 8 or connected thereto can perform both a lifting movement and a movement within the defined region 4. According to the exemplary embodiment shown in FIGS. 5, 6 and 7, the fastening member 8 is designed as an appropriately bent rectangular profile. According to the embodiment shown in FIG. 6, the defined region 4 has an elliptical shape. This is due to the fact that the fastening member 8, designed as a rectangular profile, mainly permits a movement of the striking body 3 in the direction of passage or against the direction of passage. In contrast thereto, according to FIGS. 2 and 4, the embodiment enables a defined region 4 which is round in principle to be formed. In this case, too, however, on account of the feed direction of the blocks 1, an elliptical shape for the defined region 4 will essentially appear, even though this shape is less highly pronounced.

According to the embodiment shown in FIG. 6, provision may be made for it to be possible to deflect the striking bodies 3 by 30 to 200 mm, preferably by 50 to 150 mm, in the direction of passage. Furthermore, provision may be made in this case for the next row 7 with striking bodies 3 to be at a distance from the preceding row 7 with striking bodies 3 which is 10 to 20 mm greater than the maximum deflection of the striking bodies 3 during operation.

In the exemplary embodiment, the fastening members 8 including the striking bodies 3 have a length of 200 mm. A length of 100 to 400 mm has generally proved to be advantageous.

As can be seen from FIG. 5, the retaining elements 7 have spacers 9 at regular distances apart, these spacers 9 ensuring a defined arrangement of the fastening members 8 of a row and preventing jamming with other adjacently arranged fastening members 8.

As can be seen from FIG. 6, the interior space 8*a* of the fastening members 8 may be subdivided by an intermediate bottom 8*b*, as a result of which particularly the lifting movement of the striking body 3 is accordingly limited. In this case, provision may be made for the intermediate bottom 8*b* to be capable of being set in a variable manner, as a result of which the lifting movement can be varied—if need be in relation to the blocks 1 to be aged.

FIG. 7 shows an arrangement of the striking bodies 3 in such a way that the striking bodies 3 are oriented against the direction of passage in the rest state. By the movement of the blocks 1 in the conveying direction (see arrow), the striking bodies 3 or the fastening members 8 are oriented perpendicularly in the process (illustrated by broken lines). The orientation of the striking bodies 3 in the rest state is selected in such a way that a perpendicular orientation occurs during operation. In the exemplary embodiment, the fastening members 8, on their side lying at the front in the direction of passage of the blocks 1, are loaded with an additional weight 15 (this may also be integrated in the fastening member). The additional weight 15 may also be attached to the striking body 3. The additional weight 15 achieves the effect that the striking body 3 is inclined against the conveying direction in the rest state. Such an inclination may also be achieved in another manner, e.g., by an asymmetrical or disproportional suspension and/or configuration of the fastening members 8 or of the striking bodies 3.

According to the invention, provision may, likewise, be made for at least the row 7 of striking bodies 3 which is arranged in the inlet region, i.e., the row of striking bodies 3 which the blocks pass first when being introduced into the ageing region, to be inclined in the direction of passage (not shown). In terms of design, this may be effected in a similar manner to the inclination against the direction of passage. The advantage consists in the fact that jamming of the blocks 1 with the striking bodies 3 is avoided and the blocks 1 can, therefore, easily be fed. In an alternative embodiment (not shown), provision may also be made for all the striking bodies 3 to be inclined in the direction of passage in the rest position.

In the exemplary embodiments, provision is made for the blocks 1 to be conveyed through below the striking bodies 3, i.e., for said blocks to pass through the actual ageing region, by way of a conveying device 10. A plurality of different conveying devices 10 are known from the general prior art. For example, this may involve a band, belt or chain conveyor or the like. In the exemplary embodiment, the conveying device is designed as a chain conveyor 10 having a push rod 11 which pushes the blocks 1 over the base 2, i.e., in the actual ageing region, directly over the vibrating table. Furthermore, provision is made in the exemplary embodiment for the chain conveyor 10 to push the blocks 1 continuously through below the striking bodies 3. In this case, the speed of passage can be determined in connection with the overall production rate or the ageing result to be achieved.

Alternatively, provision may also be made for the chain conveyor 10 to merely push the blocks 1 to be aged, for example an entire production layer, into the intended position and for the blocks 1 not to be pushed forward during the ageing process (discontinuous conveying). After completion of the ageing process, i.e., once the striking bodies 3 have completed their striking action on the surfaces 1*a* and the adjoining edges 1*b* of the blocks 1 to the desired degree, the chain conveyor 10 can convey the blocks 1 further and introduce a new layer to the space which has become free.

The chain conveyor 10 is designed as a circulating conveying device. In the exemplary embodiment, the two tension chains of the chain conveyor 10 are guided outside the vibrating device 6 and their operability is, therefore, not impaired by vibrations. In principle, a multiplicity of design measures are conceivable in order to ensure that the chain conveyor 10 is not subjected to vibrations. The push rod 11, which is arranged between the two circulating chains of the chain conveyor 10, is at a distance from the vibrating table or the base 2 that ensures that the vibrating table or the base 2 does not come into contact with the push rod 11. The distance between the push rod and the top side of the base 2 or of the vibrating table must, therefore, be greater than the maximum oscillation of the vibrating table or of the base 2 in the direction of the push rod 11. As a rule, the vibrating table or the base 2 oscillates or moves by no more than at most 4 mm in the direction of the push rod 11, so that a distance of, for example, 10 mm is sufficient in order to ensure that the vibrating table or the base 2 does not touch the push rod 11 and the latter can, therefore, run smoothly and unimpeded. The distance between the push rod 11 and the top side of the vibrating table or the base 2 depends in this case on the peak-to-peak displacement or the intensity of the vibration.

FIG. 1 shows an especially advantageous development of the push rod 11, which is especially suitable for use in the apparatus according to the invention. Provision is made here for the push rod 11 to be provided with a plurality of bearings 16 or rotatable elements, such as rollers, for example. In this case, if the blocks 1 come into contact with the push rod 11 on account of their vibrations, the bearings 16 ensure that only minimum rubbing of the blocks 1 on the push rod 11 takes place, as a result of which only a little kinetic energy is lost. According to the invention, provision may be made in this case for the bearings 16 to have a width of 5 to 30 mm, preferably 10 mm, and to be arranged at a distance apart of 20 to 50 mm, preferably 30 mm. First, this ensures that the blocks 1 each bear against at least two bearings 16 or are pushed forward by the latter. Second, there is little likelihood of two blocks 1 touching one bearing 16 simultaneously during the vibration, in particular with an opposed movement, as a result of which the functioning of the bearing 16 would be restricted. Independently of the solution according to the invention, such a push rod 11 may also be used in other apparatuses in which blocks 1 are aged by way of a combination of a vibrating device and striking bodies which are arranged on the surface of the blocks 1.

FIG. 1 shows lateral limit stops 12 which are intended to prevent lateral escape of the blocks 1 during the vibrating process. In principle, such limit stops 12 may also be provided in front of and behind the blocks 1 in the direction of passage. The lateral limit stops 12 may in this case also serve as dust protection. Furthermore, provision may also be made for the retaining device 5 to have a protective hood or the like which encloses the layer of blocks 1 which is to be aged in order to reduce an escape of stone dust.

In the exemplary embodiment, provision is made for the limit stops 12 to be isolated from the vibrating device 6, that is to say, they do not vibrate.

Simple design measures can ensure that the chain conveyor 10 conveys the push rod 11 in the direction of passage without the lateral limit stops 12 getting in the way. For example, the push rod 11 can be connected to the chain conveyor 10 below or above the lateral limit stops 12.

As shown in FIGS. 2 and 3 (only in principle), the region through which the blocks 1 pass under the striking action of the striking bodies 3 can have means 13 which lift at least a section of the blocks 1, so that the lifted section of the blocks 1 projects in the direction of the striking bodies 3 and is subjected to a more intense action of the striking bodies. In the exemplary embodiment, the means 13 are designed as ramp-shaped prominences which accordingly lift the blocks when the latter, with their underside, pass the ramp-shaped prominences 13. In the exemplary embodiment (not shown), provision is made for the prominences 13 to lift the blocks 1 eccentrically and thus laterally, as viewed in the direction of passage, each block 1 being lifted at least once on each side.

As shown in FIG. 2, the prominences 13 may be provided with rollers 14 or bearings.

In principle, such ramps 13 can also be realized if the conveying device is designed as a band conveying device, the band having to run over the prominences 13 in this case. However, a design as a chain conveyor 10 having a push rod 11 has proved to be more advantageous for this purpose.

It is especially advantageous if the edges 1*b* of the blocks 1 are lifted. The means 13 may be designed in various ways, for example as projections, as extendable plungers according to US 2002/0145224 A1 or the like. It is, likewise, conceivable for the means 13 to be formed by a corrugated configuration of the base 2 or of the vibratory table.

The means 13 for lifting the blocks 1 at least in sections in such a way that the lifted part of the blocks 1 projects in the direction of the striking bodies 3 and is subjected to a more intense action of the striking bodies 3 may also be used independently of the inventive idea of movably fastening the striking bodies 3. For example, such a use is also possible in the apparatus according to DE 20 2004 020 206.9. During every treatment of blocks from above, owing to the fact that the blocks are lifted at least in sections, the treatment of this section can be intensified. A desired ageing result can, therefore, be achieved in a simple manner.

For reasons of clarity, the blocks 1 are shown in the non-vibrating state in FIGS. 2, 3 and 5, the striking bodies 3 resting on the surfaces 1*a* of the blocks 1. The blocks 1 and the striking bodies 3 strike one another due to the vibration.

The distance, shown in FIGS. 2 and 5, between the blocks 1 (in the direction of passage), is reduced or eliminated during a forward movement of the push rod 11.

In an especially advantageous manner, the solution according to the invention is also suitable for the ageing of split blocks, which generally have an uneven surface or a surface provided with prominences and recesses. In this case, the split area of the block 1 is turned with its fracture surface toward the striking bodies 3.

The invention claimed is:

1. An apparatus for artificial aging blocks (1) which each have a treatment surface (1*a*) and adjoining edges (1*b*), the apparatus comprising:

a base (2) supporting an entire bottom surface the blocks (1) to be artificially aged in such a manner that the treatment surface (1*a*) and the adjoining edges (1*b*) of the blocks are exposed;

a retaining device (5) being arranged above the base (2) with the retaining device (5) having a plurality of retaining elements (7), each of the plurality of retaining elements (7) supporting a movably striking body (3) such that the respective striking body (3) moves within a defined region of the treatment surface (1*a*) of the blocks (1) to facilitate artificial aging of the blocks (1);

a vibrating device (6) for vibrating the base (2) upon which the blocks (1) are supported, and the vibrating device (6) vibrating the base (2) and the base (2), in turn, vibrating and causing at least the blocks (1) to move relative to the base (2) and the striking bodies (3) such that the striking bodies (3) and the treatment surface (1*a*) and the adjoining edges (1*b*) of the blocks strike one another and facilitate artificial aging of the blocks (1);

and an oscillating means for oscillating the retaining elements (7) back and forth at least axially along the retaining elements (7) just between the base and the retaining elements so that the striking bodies (3) only oscillate within the defined region for abutting with the top surface of the blocks (1) while the vibrating device (6) vibrates the base (2) so that the striking bodies (3) and the blocks (1) both move relative to and strike one another and thereby facilitate irregular striking of the blocks (1) and the striking bodies (3) to artificially age of the blocks (1).

2. The apparatus as claimed in claim 1, wherein the striking bodies (3) are fastened in such a way that the defined regions (4) of the individual striking bodies (3) together cover at least an entire surface of the blocks (1) to be treated.

3. The apparatus as claimed in claim 1, wherein the defined regions (4) of the individual striking bodies (3) partially overlap.

4. The apparatus as claimed in claim 1, wherein the defined region (4) of a striking body (3) has a diameter which corresponds to a movement or a deflection of the striking bodies (3) of between about 5 mm to 40 mm in all directions.

5. The apparatus as claimed in claim 1, wherein the defined region (4) has an essentially elliptical shape which and a length of the elliptical shape is between about 60 to 400 mm.

6. The apparatus as claimed in claim 1, wherein the striking bodies (3) are fastened in such a way that the striking bodies (3) avoid penetrating into an intermediate space located between two adjacent blocks (1).

7. The apparatus as claimed in claim 6, wherein the striking bodies (3) are fastened in such a way that the striking bodies (3) are spaced from and do not rest on the blocks (1) the blocks (1) and the striking bodies (3) are stationary.

8. The apparatus as claimed in claim 1, wherein the fastening of the striking bodies (3) does not restrict a lifting movement, induced by the vibrating device (6), of the striking bodies (3).

9. The apparatus as claimed in claim 1, wherein the retaining device (5) is arranged vertically above the blocks (1).

10. The apparatus as claimed in claim 9, wherein the retaining device (5) has a pattern of retaining elements (7) which extend in a plane parallel relative to the surface of the blocks (1).

11. The apparatus as claimed in claim 9, wherein the striking bodies (3) are each individually fastened to the retaining elements (7).

12. The apparatus as claimed in claim 9, wherein the striking bodies (3) are fastened to the retaining elements (7) via fastening members (8).

13. The apparatus as claimed in claim 12, wherein the fastening members (8) are one of chains, ropes, rods, profile elements and the like.

14. The apparatus as claimed in claim 12, wherein the retaining elements (7) have rail-shaped receptacles in which the fastening members (8) can be hung.

15. The apparatus as claimed in claim 12, wherein the fastening members (8) have a profile which forms an interior space (8*a*) which is suitable for enclosing a tube or a rod-shaped retaining element (7) in such a way that the fastening members (8) are movable relative to the retaining element (7) in such a way that the striking body (3) attached to the fastening members (8) perform a lifting movement.

16. The apparatus as claimed in claim 15, wherein the fastening member (8) has a bent rectangular profile.

17. The apparatus as claimed in claim 1, wherein a conveying device (10) is provided in order to convey the blocks (1) below the striking bodies (3).

18. The apparatus as claimed in claim 17, wherein the conveying device (10) operates continuously.

19. The apparatus as claimed in claim 17, wherein the conveying device (10) operates in a circulating manner and is one of a band, a chain and a belt conveying device.

20. The apparatus as claimed in claim 17, wherein the conveying device (10) has a push rod (11).

21. The apparatus as claimed in claim 1, wherein a push rod (11) is provided with a plurality of rotatable elements (16).

22. The apparatus as claimed in claim 1, wherein the striking bodies (3) are arranged in such a way that during a rest state, the striking bodies (3) are oriented against a direction of passage of the blocks (1).

23. The apparatus as claimed in claim 1, wherein at least the striking bodies (3), which lie at a rear in a direction of passage and which the blocks (1) pass first when running into the ageing region, are oriented in the direction of passage in a rest state.

24. The apparatus as claimed in claim 17, wherein means (13) which lift at least a section of the blocks (1) are provided in the region through which the blocks (1) pass under the striking action of the striking bodies (3), so that the lifted section of the block (1) projects in the direction of the striking bodies (3) and is subjected to a more intense action of the striking bodies (3).

25. The apparatus as claimed in claim 24, wherein the means are prominences (13), over which the conveying device (10) pushes the undersides of the blocks (1).

26. The apparatus as claimed in claim 25, wherein the prominences (13) lift the blocks (1) laterally when viewed in the direction of passage.

27. The apparatus as claimed in claim 25, wherein the prominences (13) are arranged in such a way that each block (1) can be lifted at least once on each side.

28. The apparatus as claimed in claim 25, wherein the prominences (13) are of ramp-shaped design.

29. The apparatus as claimed in claim 25, wherein the prominences (13) have rollers (14).

30. The apparatus as claimed in claim 1, wherein the blocks (1) are one of concrete blocks, clinker bricks and natural stone blocks.

31. The apparatus as claimed in claim 1, wherein a vertically lower most surface of each one of the striking bodies (3) lies substantially in a plane which is spaced vertically from and extends parallel to the base (2), and each of the striking bodies (3) is suspended from the retaining element (7) by a fastening member (8) such that the striking bodies (3) only contact the blocks (1) when vibrating device (6) vibrates the base (2).

32. The apparatus as claimed in claim 31, wherein the oscillating movement of the retaining elements (7) causes the striking bodies (3) to move toward and away from one another over a defined region (4) located vertically above the blocks (1).

33. A method for artificial aging blocks, which have a treatment surface (1*a*) and adjoining edges (1*b*), the method comprising the steps of:

supporting an entire bottom surface of the blocks (1) to be artificially aged solely on a base (2) in such a manner that the treatment surface (1*a*) and the adjoining edges (1*b*) of the blocks are exposed;

arranging a retaining device (5) above the base (2) with the retaining device (5) having a plurality of retaining elements (7), supporting a movably striking body (3) on each of the plurality of retaining elements (7) such that the respective striking body (3) only moves within a defined region of the treatment surface (1*a*) of the blocks (1), between the retaining device (5) and the blocks (1), to facilitate artificial aging of the blocks (1);

vibrating the base (2) upon which the blocks (1) are supported, via a vibrating device (6), such that the vibrating device (6) directly vibrates the base (2) and the base (2), in turn, vibrates and causes at least the blocks (1) to move relative to the base (2) and the striking bodies (3) such that the striking bodies (3) and the treatment surface (1*a*) and the adjoining edges (1*b*) of the blocks strike one another and facilitate artificial aging of the blocks (1);

and oscillating the retaining elements (7) axially along a length of the retaining elements (7), via an oscillating means, so that the retaining elements (7) and the striking bodies (3) only oscillate back and forth within the defined region between the retaining elements and the base for abutting with the top surface of the blocks (1) while the vibrating device (6) vibrates the base (2) so that the striking bodies (3), and the blocks (1) both move relative to and strike one another and thereby facilitate irregular striking of the blocks (1) and the striking bodies (3) to artificially age of the blocks (1).

* * * * *